US011331716B2

(12) United States Patent
Furumai et al.

(10) Patent No.: US 11,331,716 B2
(45) Date of Patent: May 17, 2022

(54) CONTINUOUS CASTING MOLD AND METHOD FOR CONTINUOUS CASTING OF STEEL (AS AMENDED)

(71) Applicant: JFE STEEL CORPORATION, Tokyo (JP)

(72) Inventors: Kohei Furumai, Hamilton (CA); Naomichi Iwata, Handa (JP); Norichika Aramaki, Fukuyama (JP); Yuji Miki, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 198 days.

(21) Appl. No.: 15/522,597

(22) PCT Filed: Oct. 23, 2015

(86) PCT No.: PCT/JP2015/005339
§ 371 (c)(1),
(2) Date: Apr. 27, 2017

(87) PCT Pub. No.: WO2016/067578
PCT Pub. Date: May 6, 2016

(65) Prior Publication Data

US 2017/0361372 A1 Dec. 21, 2017

(30) Foreign Application Priority Data

Oct. 28, 2014 (JP) ..... JP2014-218833

(51) Int. Cl.
*B22D 11/108* (2006.01)
*B22D 11/04* (2006.01)
(Continued)

(52) U.S. Cl.
CPC ..... *B22D 11/108* (2013.01); *B22D 11/04* (2013.01); *B22D 11/055* (2013.01); *B22D 11/059* (2013.01)

(58) Field of Classification Search
CPC ..... B22D 11/108; B22D 11/04; B22D 11/055; B22D 11/059
See application file for complete search history.

(56) References Cited

U.S. PATENT DOCUMENTS 2,135,183 A * 11/1938 Junghans ..... B22D 11/181 117/910
4,037,646 A * 7/1977 Hara ..... B22D 11/059 164/418
(Continued)

FOREIGN PATENT DOCUMENTS

CA 912780 A 10/1972
CN 1142207 A 2/1997
(Continued)

OTHER PUBLICATIONS

English Machine Translation of JP2008264817A (Year: 2008).*
(Continued)

*Primary Examiner* — Kevin P Kerns
*Assistant Examiner* — Steven S Ha
(74) *Attorney, Agent, or Firm* — RatnerPrestia

(57) ABSTRACT

Continuous casting mold is provided having a mold copper plate having plural separate portions filled with foreign metal formed by filling concave grooves formed on the inner wall surface of the mold copper plate and having a diameter of 2 mm to 20 mm in the inner wall surface at least in the region from a meniscus to a position located 20 mm or more lower than the meniscus with the foreign metal whose thermal conductivity is 80% or less or 125% or more of the mold copper plate, the ratio of the Vickers hardness HVc of the mold copper plate to the Vickers hardness HVm of the
(Continued)

filling metal satisfies expression (1), and the ratio of the thermal expansion coefficient $\alpha c$ of the mold copper plate and the thermal expansion coefficient $\alpha m$ of the filling metal satisfies expression (2).

$$0.3 \leq HVc/HVm \leq 2.3 \quad (1),$$

$$0.7 \leq \alpha c/\alpha m \leq 3.5 \quad (2)$$

14 Claims, 6 Drawing Sheets

(51) Int. Cl.
*B22D 11/055* (2006.01)
*B22D 11/059* (2006.01)

(56) References Cited

U.S. PATENT DOCUMENTS

| | | | | | |
|---|---|---|---|---|---|
| 4,144,993 | A * | 3/1979 | Ushio | B22D 11/059 164/138 |
| 4,787,228 | A * | 11/1988 | Weisner | B22D 11/059 72/47 |
| 5,716,510 | A | 2/1998 | Lorento | |
| 6,024,162 | A | 2/2000 | Uehara et al. | |
| 6,354,358 | B1 * | 3/2002 | Ishida | B22D 11/059 164/138 |
| 2015/0258603 | A1 | 9/2015 | Nabesima et al. | |

FOREIGN PATENT DOCUMENTS

| | | | | |
|---|---|---|---|---|
| CN | 1625450 | A | 6/2005 | |
| CN | 201482941 | U | 5/2010 | |
| CN | 102554150 | A | 7/2012 | |
| CN | 103317109 | A | 9/2013 | |
| EP | 2839901 | A1 | 2/2015 | |
| FR | 2658440 | A3 | 8/1991 | |
| GB | 1128144 | A | 9/1968 | |
| JP | S62118948 | A | 5/1987 | |
| JP | 01170550 | A | 7/1989 | |
| JP | 026037 | A | 1/1990 | |
| JP | 07284896 | A | 10/1995 | |
| JP | 09276994 | A | 10/1997 | |
| JP | 2001105102 | A | 4/2001 | |
| JP | 2002103004 | A | 4/2002 | |
| JP | 2005297001 | A | 10/2005 | |
| JP | 2008264817 | A * | 11/2008 | B22D 11/059 |
| JP | 2013078797 | A | 5/2013 | |
| JP | 2015051442 | A | 3/2015 | |
| JP | 2015107522 | A | 6/2015 | |
| RU | 2203158 | C2 | 4/2003 | |
| SU | 904879 | A1 | 2/1982 | |
| TW | 201408397 | A | 3/2014 | |
| WO | 2014002409 | A1 | 5/2016 | |

OTHER PUBLICATIONS

English Translation of Suzuki JP-01-170550 (Year: 1989).*
International Search Report and Written Opinion for International Application No. PCT/JP2015/005339, dated Jan. 26, 2016—7 Pages.
Japanese Office Action for Japanese Application No. 2016-556218, dated Aug. 29, 2017, including Concise Statement of Relevance of Office Action, 5 pages.
Extended European Search Report for European Application No. 15853748.0 , dated Jul. 5, 2017, 6 pages.
Taiwanese Office Action for Taiwanese Application No. 104135226, dated Oct. 19, 2016, including Concise Statement of Search Report, 6 pages.
Korean Office Action for Korean Application No. 10-2017-7010732, dated Apr. 9, 2018, including Concise Statement of Relevance of Office Action, 5 pages.
Russian Office Action for Russian Application No. 2017114537/02, dated Jun. 20, 2018, with Concise Statement of Search Report, 10 pages.
Korean Office Action for Korean Application No. 2017-7010732, dated Aug. 1, 2018, with Concise Statement of Relevance of Office Action, 4 pages.
Chinese Office Action for Chinese Application No. 201580057993.9, dated Sep. 12, 2018, with Concise Statement of Search Report, 10 pages.
European Communication Pursuant ot Article 94(3) for European Application No. 15853748.0, dated Sep. 3, 2019, 6 pages.
European Communication Pursuant to Article 94(3) for European Application No. 15 853 748.0, dated Mar. 6, 2020, 5 pages.

* cited by examiner

FIG. 1
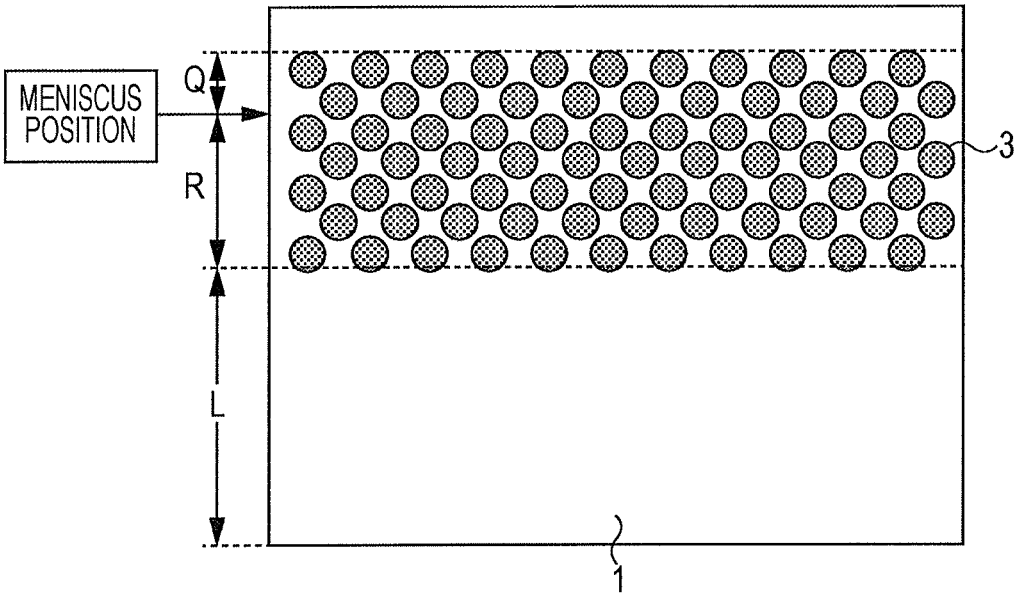
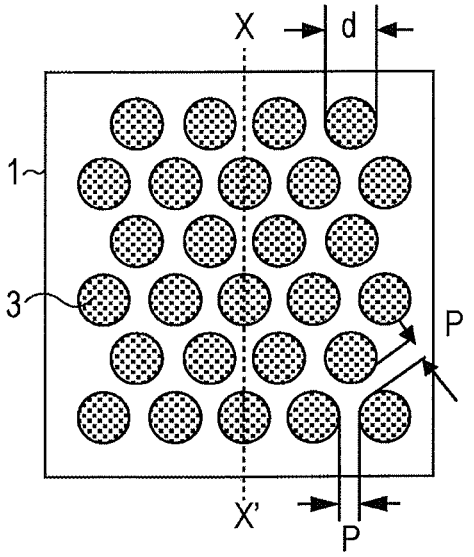
FIG. 2A
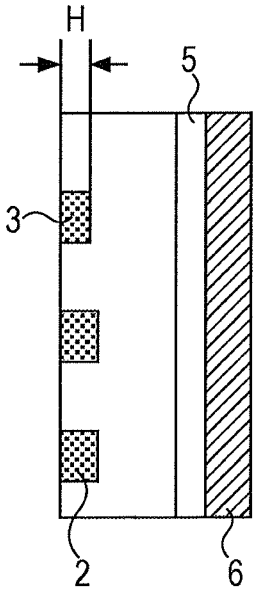
FIG. 2B

CONTINUOUS CASTING MOLD AND METHOD FOR CONTINUOUS CASTING OF STEEL (AS AMENDED)

CROSS REFERENCE TO RELATED APPLICATIONS

This is the U.S. National Phase application of PCT/JP2015/005339, filed Oct. 23, 2015, which claims priority to Japanese Patent Application No. 2014-218833, filed Oct. 28, 2014, the disclosures of these applications being incorporated herein by reference in their entireties for all purposes.

TECHNICAL FIELD OF THE INVENTION

The present invention relates to a continuous casting mold with which continuous casting can be performed while preventing a crack on the surface of a cast piece caused by inhomogeneous cooling of a solidified shell in the mold and to a method for continuously casting steel by using this mold.

BACKGROUND OF THE INVENTION

In a continuous casting process for steel, since molten steel which is poured into a mold is cooled using a water-cooled mold, a solidified layer (called "solidified shell") is formed as a result of the surface portion of the molten steel which is in contact with the mold being solidified. A cast piece having the solidified shell as an outer shell and a non-solidified layer inside the shell is continuously drawn in a downward direction through the mold while the cast piece is cooled by using water sprays or air-water sprays which are installed on the downstream side of the mold. The cast piece is solidified including the central portion in the thickness direction as a result of being cooled by using the water sprays or the air-water sprays, and then cut into cast pieces having a specified length by using, for example, a gas cutting machine.

In the case where inhomogeneous cooling occurs in the mold, there is a fluctuation in the thickness of the solidified shell in the casting direction and width direction of the cast piece. The solidified shell is subjected to stress caused by the shrinkage and deformation of the solidified shell. In the early solidification stage, since this stress is concentrated in a thin portion of the solidified shell, a crack occurs on the surface of the solidified shell due to this stress. Such a crack grows into a large surface crack afterward due to an external force caused by, for example, thermal stress, and bending stress and leveling stress which are applied by the rolls of the continuous casting machine. The crack on the surface of the cast piece becomes a surface defect of a steel product in a subsequent rolling process. Therefore, in order to prevent the surface defect of the steel product from occurring, it is necessary to remove the surface crack at the cast piece stage by performing scarfing or polishing on the surface of the cast piece.

Inhomogeneous solidification in the mold tends to occur, in particular, in the case of steel having a carbon content of 0.08 mass % to 0.17 mass %. In the case of steel having a carbon content of 0.08 mass % to 0.17 mass %, a peritectic reaction occurs at the time of solidification. It is considered that inhomogeneous solidification in the mold is caused by transformation stress due to a decrease in volume which occurs when transformation from δ iron (ferrite phase) to γ iron (austenite phase) occurs due to this peritectic reaction. That is, since the solidified shell is deformed due to strain caused by this transformation stress, the solidified shell is detached from the inner wall surface of the mold due to this deformation. Since the portion which has been detached from the inner wall surface of the mold becomes less likely to be cooled through the mold, there is a decrease in the thickness of the solidified shell in this portion which has been detached from the inner wall surface of the mold (this portion which is detached from the inner wall surface of the mold is referred to as a "depression"). It is considered that, since there is a decrease in the thickness of the solidified shell, a surface crack occurs due to the stress described above being concentrated in this portion.

In particular, in the case where there is an increase in cast piece drawing speed, since there is an increase in average thermal flux from the solidified shell to mold cooling water (the solidified shell is rapidly cooled), and since the distribution of thermal flux becomes irregular and inhomogeneous, there is a tendency for the number of cracks occurring on the surface of the cast piece to increase. Specifically, in the case of a machine for continuously casting a slab having a cast-piece thickness of 200 mm or more, a surface crack tends to occur when the cast piece drawing speed is 1.5 m/min or more.

There have been experiments in which mold powder having a chemical composition which tends to cause crystallization is used in order to prevent the occurrence of a crack on the surface of a cast piece of a steel grade (referred to as "medium-carbon steel") in which the peritectic reaction described above tends to occur (for example, refer to Patent Literature 1). This is based on the fact that, in the case of mold powder having a chemical composition which tends to cause crystallization, there is an increase in the thermal resistance of a mold powder layer, and a solidified shell is slowly cooled. Since there is a decrease in stress applied to the solidified shell due to slow cooling, a surface crack is less likely to occur. However, with only the effect of slow cooling through the use of mold powder, there is an insufficient improvement in inhomogeneous solidification, and therefore it is not possible to prevent a surface crack from occurring in the case of a steel grade which tends to be subjected to a large amount of decrease in volume due to transformation.

In addition, there have also been methods proposed in which the degree of inhomogeneous solidification is decreased by providing a regular distribution of heat transfer as a result of mold powder flowing into concave portions (vertical grooves, grid grooves, or circular holes) which are formed on the inner wall surface of a mold (for example, refer to Patent Literature 2). However, in the case of these methods, there is a problem in that, in the case where an insufficient amount of mold powder flows into the concave portions, constrained breakout occurs due to molten steel flowing into the concave portions, or in that constrained breakout occurs as a result of mold powder being removed from the concave portions during casting and molten steel flowing into the concave portions left by the removed mold powder.

On the other hand, in order to decrease the degree of inhomogeneous solidification by providing a regular distribution of thermal conduction, there have been methods proposed in which grooves (vertical grooves or grid grooves) are formed on the inner wall surface of a mold copper plate and in which the grooves are filled with a low-thermal-conductivity material (for example, refer to Patent Literature 3 and Patent Literature 4). In the case of these methods, there is a problem in that, since stress caused by a difference in thermal strain between the low-thermal-conductivity material with which the vertical grooves or the grid grooves are filled and the mold copper plate is applied to the interface between the low-thermal-conductivity material and the mold copper plate and to the intersections of the grid portions, cracks occur on the surface of the mold copper plate.

PTL 1: Japanese Unexamined Patent Application Publication No. 2005-297001.

PTL 2: Japanese Unexamined Patent Application Publication No. 9-276994.

PTL 3: Japanese Unexamined Patent Application Publication No. 2-6037.

PTL 4: Japanese Unexamined Patent Application Publication No. 7-284896.

SUMMARY OF THE INVENTION

The present invention has been completed in view of the situation described above, and an object of the present invention is to provide a continuous casting mold with which it is possible to prevent a surface crack due to the inhomogeneous cooling of a solidified shell in the early solidification stage, that is, e.g., a surface crack due to a variation in the thickness of a solidified shell without the occurrence of constrained breakout and a decrease in the life of the mold due to the crack on the surface of the mold by forming, on the inner wall surface of the continuous casting mold, plural separate portions which are filled with a kind of metal which is different from the material of the mold and whose thermal conductivity is lower or higher than that of the mold and to provide a method for continuously casting steel by using the continuous casting mold.

The subject matter of the present invention, as described by way of non-limiting embodiments of the present invention, in order to solve the problems described above is as follows.

[1] A continuous casting mold having a mold copper plate composed of copper or a copper alloy, the mold including: plural separate portions filled with a foreign metal of which thermal conductivity is 80% or less of thermal conductivity of the mold copper plate or 125% or more thereof, the plural separate portions being formed as circular concave grooves having a diameter of 2 mm to 20 mm or as quasi-circular concave grooves having a circle-equivalent diameter of 2 mm to 20 mm, the grooves being provided on an inner wall surface of the mold copper plate, and the plural separate portions being formed at least in a region from a meniscus to a position located 20 mm or more lower than the meniscus, the region being whole or part of the inner wall surface, wherein, a ratio of Vickers hardness HVc [kgf/mm$^2$] of the mold copper plate to Vickers hardness HVm [kgf/mm$^2$] of filled foreign metal satisfies relational expression (1) below:

$$0.3 \leq HVc/HVm \leq 2.3 \quad (1), \text{ and}$$

the ratio of the thermal expansion coefficient $\alpha c$ [μm/(m×K)] of the mold copper plate to the thermal expansion coefficient $\alpha m$ [μm/(m×K)] of the filled foreign metal satisfies relational expression (2) below:

$$0.7 \leq \alpha c/\alpha m \leq 3.5 \quad (2).$$

[2] The continuous casting mold according to item [1] above, wherein a coating layer is formed on the inner wall surface by a plating method or a thermal spraying method, the coating layer having a breaking elongation of 8.0% or more, and the portions filled with the foreign metal are covered with the coating layer.

[3] The continuous casting mold according to item [2] above, wherein the coating layer contains nickel or a nickel-cobalt alloy (having a cobalt content of 50 mass % or more).

[4] A method for continuous casting of steel using the continuous casting mold according to any one of items [1] to [3] above, the method including steps of: pouring molten steel into the mold and cooling the molten steel in the mold in order to form a solidified shell; and drawing a cast piece having the solidified shell as an outer shell and non-solidified molten steel inside the solidified shell out of the mold in order to manufacture a cast piece.

[5] The method for continuous casting of steel according to item [4] above, the method further including steps of: oscillating the mold copper plate; and pouring mold powder onto the surface of the molten steel which has been poured into the mold during the oscillating, wherein the mold powder contains CaO, $SiO_2$, $Al_2O_3$, $Na_2O$, and $Li_2O$ and the basicity, which is expressed by the ratio ((CaO by mass %)/($SiO_2$ by mass %)) of CaO concentration to $SiO_2$ concentration in the mold powder, is 1.0 or more and 2.0 or less, and in which the sum of $Na_2O$ concentration and $Li_2O$ concentration is 5.0 mass % or more and 10.0 mass % or less.

[6] The method for continuous casting of steel according to item [5] above, the method further comprising steps of: cooling the mold so that the total amount Q of heat extracted through the mold is 0.5 MW/m$^2$ or more and 2.5 MW/m$^2$ or less.

According to aspects of the present invention, since plural portions filled with a foreign metal are arranged in the width direction and casting direction of the mold copper plate of a continuous casting mold in a region in the vicinity of a meniscus including the meniscus, the thermal resistance of the continuous casting mold increases and decreases regularly and periodically in the width direction and casting direction of the mold in the vicinity of the meniscus. With this, the thermal flux from a solidified shell to the continuous casting mold increases and decreases regularly and periodically in the vicinity of the meniscus, that is, in the early solidification stage. As a result of such regular and periodic increase and decrease in thermal flux, since there is a decrease in stress due to transformation from δ iron to γ iron and in thermal stress, the amount of deformation of the solidified shell caused by these stresses decreases. As a result of a decrease in the amount of deformation of the solidified shell, an inhomogeneous distribution of thermal flux caused by the deformation of the solidified shell is homogenized, and, since generated stress is de-concentrated, there is a decrease in the amounts of various strains, which results in a crack being prevented from occurring on the surface of the solidified shell.

Moreover, according to aspects of the present invention, since the ratio of the Vickers hardness HVc of the mold copper plate to the Vickers hardness HVm of the foreign metal and the ratio of the thermal expansion coefficient $\alpha c$ of the mold copper plate to the thermal expansion coefficient $\alpha m$ of the foreign metal are controlled to be within the specified ranges, it is possible to decrease stress applied to the surface of the mold copper plate caused by the difference in the amount of abrasion of the surface of the mold copper plate due to the difference in hardness between the mold copper plate and the portions filled with the foreign metal, and the difference in thermal expansion. Therefore, the life of the mold copper plate becomes longer.

BRIEF DESCRIPTION OF THE DRAWINGS

FIG. 1 is a schematic diagram viewed from the inner wall surface side of a copper plate on the long side of a mold constituting a part of the continuous casting mold according to an example of an embodiment of the present invention.

FIG. 2A is an enlarged view of a part of the copper plate on the long side of the mold in FIG. 1 in which portions filled with a foreign metal are formed.

FIG. 2B is a cross-sectional view of FIG. 2A along the line X-X'.

DETAILED DESCRIPTION OF EMBODIMENTS OF THE INVENTION

Figure 3:
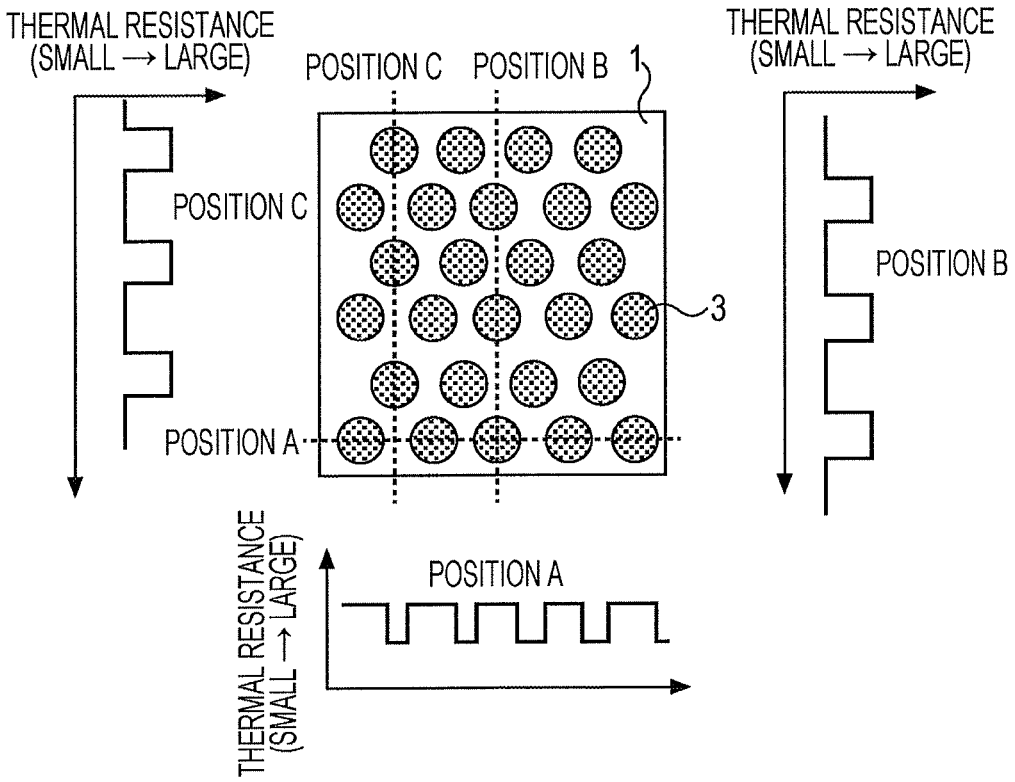
FIG. 3 is a conceptual diagram illustrating the thermal resistance distributions in accordance with the positions where portions filled with a foreign metal are formed at three positions on a copper plate having portions filled with a foreign metal on the long side of a mold.

Hereafter, an example of an embodiment of the present invention will be described with reference to the accompanying drawings. FIG. 1 is a schematic diagram viewed from the inner wall surface side of a copper plate on the long side of a mold constituting a part of the continuous casting mold according to an example of an embodiment of the present invention. The continuous casting mold illustrated in FIG. 1 is an example of a continuous casting mold used for casting a cast slab, and the continuous casting mold for a cast slab consists of a combination of a pair of copper plates on the long sides of the mold and a pair of copper plates on the short sides of the mold. FIG. 1 illustrates the copper plate on the long side of the mold among the copper plates.

Plural circular concave grooves (refer to reference sign 2 in FIG. 2(B)) are formed in the region of the inner wall surface of the copper plate 1 on the long side of the mold from a position located higher than the position of a meniscus, which is formed when ordinary casting is performed, and at a distance Q from the meniscus (distance Q is assigned a value equal to or larger than zero) to a position located lower than the meniscus and at a distance R from the meniscus (distance R is assigned a value equal to or larger than 20 mm). Plural portions 3 filled with a foreign metal are formed by filling such circular concave grooves with a metal (hereinafter referred to as "foreign metal") whose thermal conductivity is lower or higher than that of a mold copper plate. Here, symbol L in FIG. 1 denotes a length in the casting direction of the lower part of the mold in the region in which the portions 3 filled with a foreign metal are not formed, that is, a distance between the lower edge of the region in which the portions 3 filled with a foreign metal are formed and the lower edge of the mold.

Here, the term "meniscus" refers to "the upper surface of molten steel in a mold", and, although its position is not clear when casting is not performed, the meniscus position is controlled to be about 50 mm to 200 mm lower than the upper edge of the mold copper plate in an ordinary continuous casting operation for steel. Therefore, even in the case where the meniscus position is 50 mm or 200 mm lower than the upper edge of the copper plate 1 on the long side of the mold, the portions 3 filled with a foreign metal may be arranged so that distance Q and distance R satisfy the conditions according to an example of an embodiment of the present invention as described below.

That is, in consideration of an influence on early-stage solidification of a solidified shell, according to one example it is necessary that the portions 3 filled with a foreign metal be formed at least in a region from the meniscus to a position located, preferably, 20 mm lower than the meniscus, and therefore in such an example it may be necessary that distance R be 20 mm or more.

The amount of heat extracted through a continuous casting mold is larger in the vicinity of a meniscus position than at other positions. That is, thermal flux q in the vicinity of the meniscus position is higher than thermal flux q at other positions. From the results of experiments conducted by the present inventors, while thermal flux q is lower than 1.5 $MW/m^2$ at a position located 30 mm lower than the meniscus, thermal flux q is almost 1.5 $MW/m^2$ or more at a position located 20 mm lower than the meniscus, although the results depend on the flow rate of cooling water fed to a mold and a cast piece drawing speed.

In an aspect of the present invention, heat resistance is controlled on the inner wall surface of a mold in the vicinity of a meniscus position. With this, since the effect of a periodic variation in thermal flux caused by the portions 3 filled with a foreign metal is sufficiently realized, the effect of preventing the occurrence of a crack on the surface of a cast piece can be sufficiently realized even under conditions in which a surface crack tends to occur, for example, when high-speed casting is performed or when medium-carbon steel is cast. That is, in consideration of an influence on early-stage solidification, it is necessary that the portions 3 filled with a foreign metal be formed at least in a region from the meniscus to a position located preferably 20 mm lower than the meniscus in which thermal flux q is large. In the case where distance R is less than 20 mm, there is an insufficient effect of preventing the occurrence of a crack on the surface of a cast piece.

On the other hand, since the upper edge of the region in which the portions 3 filled with a foreign metal are formed may be located at any position as long as the position is located at the same position as the meniscus or at a position higher than the meniscus, distance Q may be assigned any value equal to or larger than zero. However, since it is necessary that the meniscus be located within the region in which the portions 3 filled with a foreign metal are formed when casting is performed, and since the meniscus moves in an up and down direction when casting is performed, in order to ensure that the upper edge of the region in which the portions 3 filled with a foreign metal are formed is always higher than the meniscus, it is preferable that the upper edge be located about 10 mm higher than the estimated position of meniscus, or more preferably about 20 mm to 50 mm higher than that of the meniscus.

Under the assumption that the portions 3 filled with a foreign metal are also formed on the inner wall surface of a copper plate on the short side of a mold, which is not illustrated, as is the case with a copper plate 1 on the long side of the mold, the description regarding the copper plate on the short side of the mold will be omitted hereinafter. However, since stress concentration tends to occur in a solidified shell on the surface on the long side of the mold due to the shape of the cast slab, a crack tends to occur on the surface on the long side of the mold. Therefore, it is not always necessary to form portions 3 filled with a foreign metal on the copper plate on the short side of the mold of a continuous casting mold for a cast slab. In addition, although the portions 3 filled with a foreign metal are formed across the whole width of the inner wall surface of the mold copper plate 1 on the long side of the mold in FIG. 1, it is acceptable that the portions 3 filled with a foreign metal are formed only in a part corresponding to the central portion in the width direction of the cast piece in which stress concentration tends to occur in the solidified shell of a cast piece.

FIGS. 2A and 2B are enlarged views of a part of the copper plate on the long side of the mold in FIG. 1 in which portions filled with a foreign metal are formed. FIG. 2A is a diagram of the part viewed from the inner wall surface side, and FIG. 2B is the cross-sectional view of FIG. 2A along the line X-X'. The portions 3 filled with a foreign metal may bee formed by filling circular concave grooves 2 having a diameter d of, e.g., 2 mm to 20 mm with a foreign metal whose thermal conductivity is 80% or less or 125% or more of that of the mold copper plate, which are separately formed on the inner wall surface of the copper plate 1 on the long side of the mold, by using, for example, a plating method or a thermal spraying method. In FIG. 2, reference sign 5 indicates a cooling water flow channel, and reference sign 6 indicates a back plate.

Here, it is preferable that the filling thickness H of the portions 3 filled with a foreign metal be 0.5 mm or more. By controlling the filling thickness to be 0.5 mm or more, there is a sufficient decrease in thermal flux in the portions 3 filled with a foreign metal. It is not necessary that the distance P between the portions filled with a foreign metal be constant for all the portions filled with a foreign metal. However, in order to ensure that a variation in thermal resistance described below is periodical, it is preferable that the distance P between the portions filled with a foreign metal be constant for all the portions filled with a foreign metal.

FIG. 3 is a conceptual diagram illustrating the thermal resistance distributions in accordance with the positions where portions 3 filled with a foreign metal are formed at three positions on a copper plate 1 on the long side of a mold. By arranging plural portions 3 filled with a foreign metal, which are filled with a metal whose thermal conductivity is lower than that of the mold copper plate, that is, plural portions 3 filled with a foreign metal, whose thermal resistance is higher than that of the copper plate 1, in the width direction and casting direction of a continuous casting mold in a region in the vicinity of a meniscus including the meniscus, the thermal resistance of the continuous casting mold increases and decreases regularly and periodically in the width direction and casting direction of the mold in the vicinity of the meniscus. Therefore, the thermal flux from a solidified shell to the continuous casting mold increases and decreases regularly and periodically in the vicinity of the meniscus, that is, in the early solidification stage. As a result of such regular and periodic increase and decrease in thermal flux, there is a decrease in stress caused by transformation from δ iron to γ iron and in thermal stress, and the amount of deformation of the solidified shell caused by these stresses decreases. As a result of a decrease in the amount of deformation of the solidified shell, an inhomogeneous distribution of thermal flux caused by the deformation of the solidified shell is homogenized, and since generated stress is de-concentrated, there is a decrease in the amounts of various strains, which results in a crack being prevented from occurring on the surface of the solidified shell.

In accordance with one aspect of the present invention, pure copper or a copper alloy is used for a mold copper plate. As a copper alloy used for a mold copper plate, a copper alloy to which, for example, small amounts of chromium (Cr) and zirconium (Zr) which are generally used for the mold copper plate of a continuous casting mold are added may be used. Nowadays, in order to realize uniform solidification in a mold or in order to prevent inclusions in molten steel from being trapped in a solidified shell, an electromagnetic stirring device, with which molten steel in a mold is stirred, is generally provided. In the case where an electromagnetic stirring device is provided, in order to inhibit the attenuation of the strength of a magnetic field applied from an electromagnetic coil to molten steel, a copper alloy whose electrical conductivity is decreased is used. In this case, thermal conductivity decreases with a decrease in electrical conductivity, and there is a case where a mold copper plate of a copper alloy whose thermal conductivity is about ½ of that of pure copper (having a thermal conductivity of 398 W/(m×K)) is used. Generally, the thermal conductivity of a copper alloy which is used for a mold copper plate is lower than that of pure copper.

It is important that a metal whose thermal conductivity is 80% or less or 125% or more of that of a mold copper plate be used as a foreign metal with which circular concave grooves 2 are filled. In the case where the thermal conductivity of the foreign metal is more than 80% or less than 125% of that of the mold copper plate, there is an insufficient effect of a periodical variation in thermal flux through the use of the portions 3 filled with a foreign metal, and therefore there is an insufficient effect of preventing a crack on the surface of a cast piece under conditions in which a surface crack tends to occur, for example, when high-speed casting is performed or when medium-carbon steel is cast.

Examples of a foreign metal with which circular concave grooves 2 can preferably be filled include nickel (Ni, having a thermal conductivity of about 90 W/(m·K)), a nickel alloy (having a thermal conductivity of about 40 W/(m·K) to 90 W/(m·K)), chromium (Cr, having a thermal conductivity of 67 W/(m×K)), and cobalt (Co, having a thermal conductivity of 70 W/(m×K)), which are easy to use in plating or thermal spraying. In addition, a copper alloy (having a thermal conductivity of about 100 W/(m·K) to 398 W/(m·K)) or pure copper may also be used as a foreign metal with which circular concave grooves 2 are filled in accordance with the thermal conductivity of the mold copper plate. In the case where a copper alloy whose thermal conductivity is low is used for a mold copper plate and pure copper is used as a foreign metal, the thermal resistance of a part in which portions 3 filled with a foreign metal are formed is lower than that of a part of the mold copper plate.

Although the shape of portions 3 filled with a foreign metal formed on the inner wall surface of a copper plate 1 on the long side of a mold is circular in FIG. 1 and FIG. 2, the shape is not necessarily circular. Any kind of shape may be used as long as the shape is one similar to a circle such as an ellipse which does not have a so-called "corner". Hereinafter, a shape similar to a circle will be referred to as a "quasi-circle". In the case where the shape of portions 3 filled with a foreign metal is a quasi-circle, a groove formed on the inner wall surface of the copper plate 1 on the long side of the mold in order to form the portions 3 filled with a foreign metal will be referred to as a "quasi-circle groove". Examples of a quasi-circle include an ellipse and a rectangle having corners having a shape of a circular arc which have no angulated corner, and, further, a shape such as a petal-shaped pattern may be used. The size of a quasi-circle is measured in terms of a circle-equivalent diameter, which is calculated from the area of the quasi-circle. The circle-equivalent diameter d of a quasi-circle is calculated by using equation (3) below.

$$\text{circle-equivalent diameter } d=(4\times S/\pi)^{1/2} \quad (3)$$

Here, in equation (3), S denotes the area ($mm^2$) of a portion 3 filled with a foreign metal.

In the case of Patent Literature 4 where vertical grooves or grid grooves are formed and where the grooves are filled with a foreign metal, there is a problem in that, since stress caused by a difference in thermal strain between the foreign metal and copper is concentrated at the interface between the foreign metal and the copper and at the intersections of the grid portions, cracks occur on the surface of the mold copper plate. In contrast, in the case, according to an aspect of the present invention, where the shape of the portions 3 filled with a foreign metal is circular or quasi-circular, since stress is less likely to be concentrated at the interface due to the shape of the interface between the foreign metal and copper being a curved surface, there is an advantage in that a crack is less likely to occur on the surface of a mold copper plate.

It is important that the portions 3 filled with a foreign metal have a diameter d or a circle-equivalent diameter d of 2 mm to 20 mm. By controlling the diameter d or the circle-equivalent diameter d to be 2 mm or more, there is a sufficient decrease in thermal flux in the portions 3 filled with a foreign metal, and therefore it is possible to realize the effects described above. In addition, by controlling the diameter d or the circle-equivalent diameter d of the portions 3 filled with a foreign metal to be 2 mm or more, it is easy to fill circular concave grooves 2 or quasi-circular concave grooves (not illustrated) with the foreign metal by using a plating method or a thermal spraying method. On the other hand, by controlling the diameter d or circle-equivalent diameter d of the portions 3 filled with a foreign metal to be 20 mm or less, a decrease in thermal flux in the portions 3 filled with a foreign metal is inhibited, that is, solidification delay in the portions 3 filled with a foreign metal is inhibited, and thus stress concentration in a solidified shell at positions corresponding to the portions 3 is prevented, which results in a crack being prevented from occurring on the surface of the solidified shell. That is, since a surface crack occurs in the case where the diameter d or the circle-equivalent diameter d is more than 20 mm, it is necessary that the portions 3 filled with a foreign metal have a diameter d or a circle-equivalent diameter d of 20 mm or less.

Figure 4:
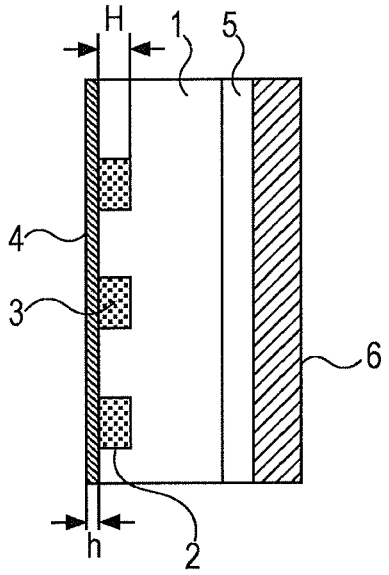
FIG. 4 is a diagram illustrating an example in which a coating layer is formed by using a plating method on the inner wall surface of a mold copper plate in order to protect the surface of the mold copper plate.

In addition, in order to prevent abrasion caused by a solidified shell and a crack on the mold surface due to a thermal history, it is preferable that a coating layer be formed by using a plating method or a thermal spraying method on the inner wall surface of a mold copper plate on which the portions 3 filled with a foreign metal are formed. FIG. 4 is a diagram illustrating an example in which a coating layer 4 is formed by using a plating method on the inner wall surface of a mold copper plate in order to protect the surface of the mold copper plate. It is sufficient to form the coating layer 4 by performing plating by using commonly used nickel or a nickel-based alloy such as a nickel-cobalt alloy (Ni—Co alloy having a cobalt content of 50 mass % or more). However, it is preferable that the thickness h of the coating layer 4 be 2.0 mm or less. By controlling the thickness h of the coating layer 4 to be 2.0 mm or less, the influence of the coating layer 4 on thermal flux can be reduced, and it is possible to sufficiently realize the effects of a periodic variation in thermal flux caused by the portions 3 filled with a foreign meal. Also, in the case where the coating layer is formed by using a thermal spraying method, the coating layer may be formed in the same manner as described above.

Although the portions 3 filled with a foreign metal having the same shape are formed in the casting direction or the width direction of the mold in FIG. 1, it is not always necessary, according to aspects of the present invention, that portions 3 filled with a foreign metal having the same shape be formed. In addition, as long as the diameter or circle-equivalent diameter of the portions 3 filled with a foreign metal is within a range of, preferably, 2 mm to 20 mm, the diameter of the portions 3 filled with a foreign metal may vary in the casting direction or the width direction of the mold. Also, in this case, it is possible to prevent the occurrence of a crack on the surface of a cast piece caused by the inhomogeneous cooling of a solidified shell in the mold.

<Experiment 1>

An experiment was conducted in order to investigate the relationship between the diameter d of portions 3 filled with a foreign metal which were formed on the inner wall surface of a mold copper plate and the number density of cracks on the surface of a cast slab which was manufactured by using the mold. In this experiment, a water-cooled copper mold whose inner space had a long side length of 2.1 m and a short side length of 0.25 m and which had portions 3 filled with a foreign metal formed on the inner wall surface thereof was used. The length (=mold length) from the upper edge to the lower edge of the water-cooled copper mold was 900 mm, the meniscus was located 80 mm lower than the upper edge of the mold in the test, and the portions 3 filled with a foreign metal were formed on the inner wall surface of the mold in a region from a position located 30 mm higher than the meniscus to a position located 190 mm lower than the meniscus (the length of the region: (distance Q+distance R)=220 mm).

In this experiment, continuous casting of steel was performed plural times by using a continuous casting mold in which a copper alloy having a thermal conductivity $\lambda c$ of 119 W/(m·K) was used for the mold copper plate, a nickel alloy (having a thermal conductivity of 90 W/(m·K)) was used as the foreign metal, and plural circular portions 3 filled with the foreign metal having a filling thickness H of 0.5 mm were formed.

By performing continuous casting tests with various values for the diameter d of circular convex grooves 2, that is, the diameter d of portions 3 filled with a foreign metal, the surface crack density of the cast slab was determined. By finding cracks on the surface of the cast slab by performing a visual test using color check, by determining the length of each of longitudinal cracks on the surface of the cast piece, by defining a longitudinal crack having a length of 1 cm or more as a surface crack, and by counting the number of cracks on the surface of the cast slab, the number density of surface crack (number/$m^2$) was calculated.

Figure 5:
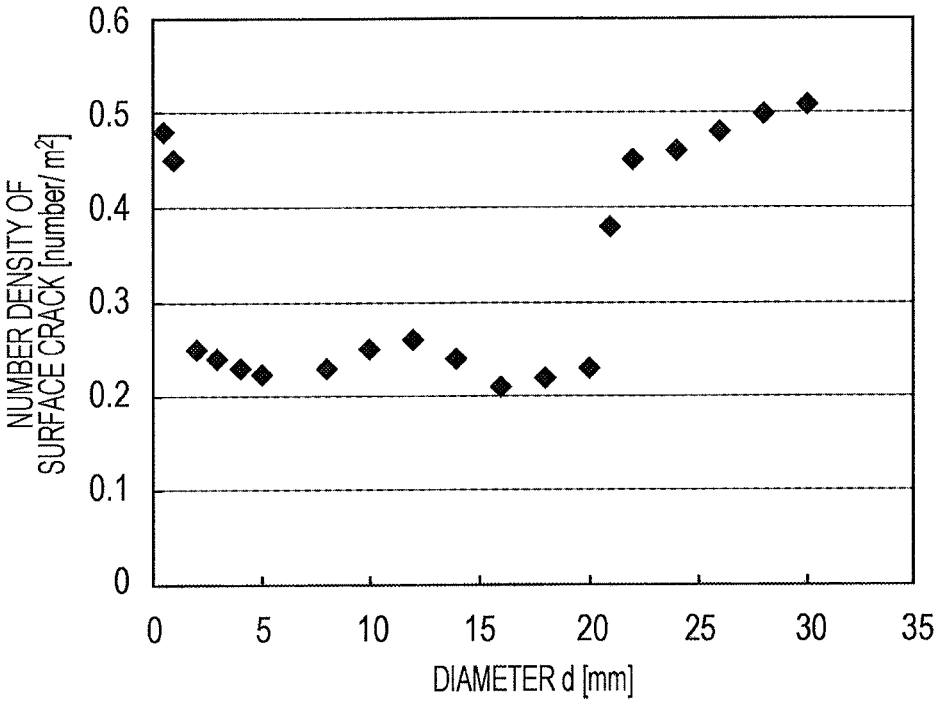
FIG. 5 is a graph illustrating the relationship between the diameter of portions filled with a foreign metal and the number density of cracks on the surface of a cast slab.

FIG. 5 illustrates the relationship between the diameter d of portions 3 filled with a foreign metal and the number density of cracks on the surface of the cast slab. In the case where the diameter of portions 3 filled with a foreign metal was less than 2 mm or more than 20 mm, a large number of cracks occurred on the surface of the cast slab. It is presumed that, in the case where the diameter of portions 3 filled with a foreign metal was less than 2 mm or more than 20 mm, since transformation stress caused by a decrease in volume at the time of the transformation of the solidified shell is not de-concentrated, stress concentration occurred, which results in the number density of cracks on the surface of the cast slab being larger than in the case where portions 3 filled with a foreign metal having a diameter d of 2 mm to 20 mm were formed.

<Experiment 2>

Since the physical properties such as an expansion coefficient of portions 3 filled with a foreign metal are different from those of a mold copper plate (pure copper or a copper alloy), the portions 3 filled with a foreign metal tend to be detached from the interface to the mold copper plate. Accordingly, the life of the continuous casting mold, according to one embodiment of the present invention, tends to be shorter than that of a conventional mold on which the portions 3 filled with a foreign metal are not formed. Therefore, the present inventors diligently conducted investigations regarding the physical properties of portions 3 filled with a foreign metal, and, as a result, reached a conclusion that the durability of a mold depends on the ratio of the Vickers hardness of a mold copper plate to the Vickers hardness of a foreign metal and the ratio of the thermal expansion coefficient of a mold copper plate to the thermal expansion coefficient of a foreign metal. The tests were performed in order to confirm this conclusion.

Figure 6:
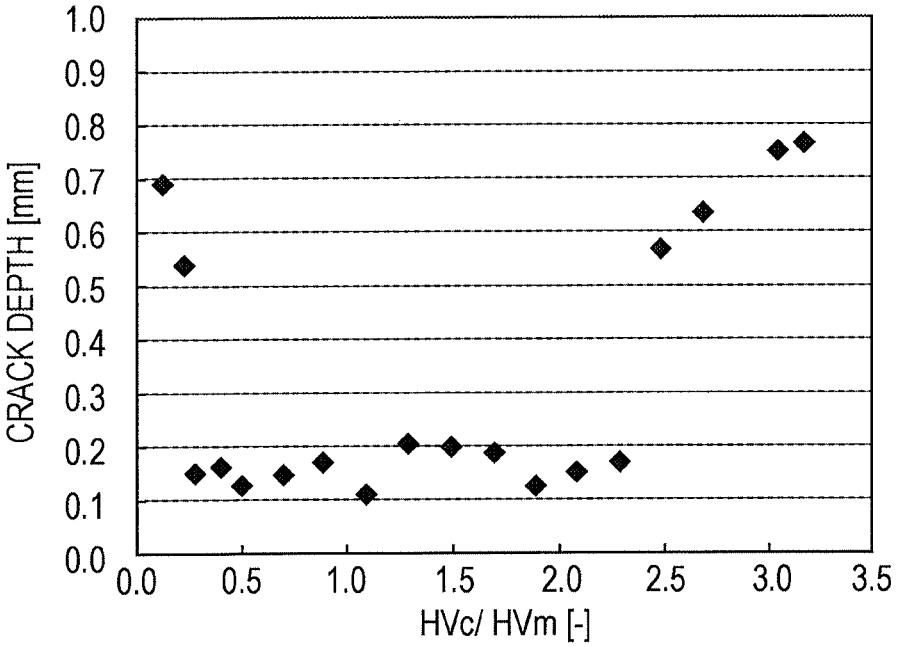
FIG. 6 is a graph illustrating the relationship between HVc/HVm and the crack depth at the interface between a foreign metal and a mold copper plate.

By using a mold having a size smaller than that of the mold used in the Experiment 1, experimental continuous casting was performed 300 times as tests in order to check the life limit of the mold. By performing experimental continuous casting 300 times, a crack tends to occur at the interface on the inner wall surface between a mold copper plate and a foreign metal in most cases. Such 300-time experimental continuous casting was performed plural times. The tests were performed by using molds having various values for HVc/HVm and $\alpha c/\alpha m$ by changing the metal (pure copper or a copper alloy) of which the mold copper plate was composed and the metal of which portions 3 filled with a foreign metal were composed. The depth of a crack which occurred, that is, the depth of a crack of the mold, which occurred at the interface, from the surface of the mold was determined by using an ultrasonic flaw inspection method. FIG. 6 is a graph illustrating the relationship between HVc/HVm and the depth of a crack at the interface between the foreign metal and the mold copper plate, and FIG. 7 is a graph illustrating the relationship between $\alpha c/\alpha m$ and the above-described crack depth [mm].

Figure 7:
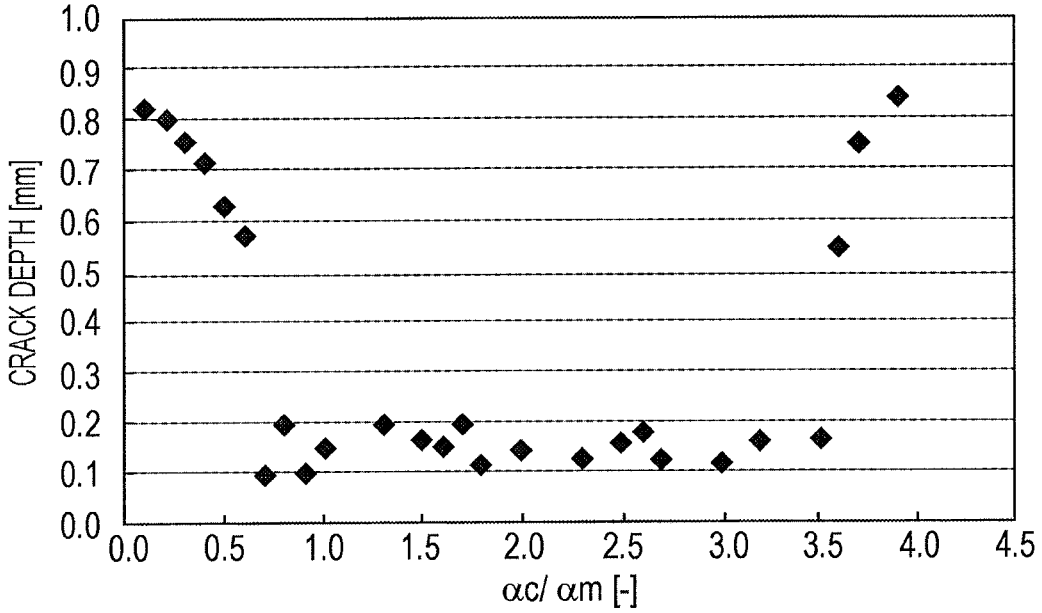
FIG. 7 is a graph illustrating the relationship between $\alpha c/\alpha m$ and the crack depth at the interface between a foreign metal and a mold copper plate.

As FIG. 6 and FIG. 7 indicate, in the case where HVc/HVm is 0.3 or more and 2.3 or less and where $\alpha c/\alpha m$ is 0.7 or more and 3.5 or less, it is possible to make the crack depth much smaller than in other cases, even if cracks occur on the inner wall surface of a mold.

That is, in accordance with one embodiment of the present invention, it is necessary that the ratio of the Vickers hardness of a mold copper plate to the Vickers hardness of a foreign metal satisfy relational expression (1) below.

$$0.3 \leq HVc/HVm \leq 2.3 \quad (1)$$

Here, in relational expression (1), HVc denotes the Vickers hardness (unit: kgf/$mm^2$) of a mold copper plate and HVm denotes the Vickers hardness (unit: kgf/$mm^2$) of a foreign metal. It is possible to determine Vickers hardness HV by performing a Vickers hardness test prescribed in JIS Z 2244. For example, Vickers hardness HVc is 37.6 kgf/$mm^2$ in the case where pure copper is used for a mold copper plate, and Vickers hardness HVm is 65.1 kgf/$mm^2$ in the case where nickel is used as a foreign metal.

In addition, in accordance with one embodiment of the present invention, it is necessary that the ratio of the thermal expansion coefficient of a mold copper plate to the thermal expansion coefficient of a foreign metal satisfy relational expression (2) below.

$$0.7 \leq \alpha c/\alpha m \leq 3.5 \quad (2)$$

Here, in relational expression (2), $\alpha c$ denotes the thermal expansion coefficient (unit: μm/(m×K)) of a mold, and $\alpha m$ denotes the thermal expansion coefficient (unit: μm/(m×K)) of a foreign metal. It is possible to determine thermal expansion coefficient $\alpha$ by using a thermal mechanical analysis (TMA) apparatus. For example, thermal expansion coefficient $\alpha c$ is 16.5 μm/(m×K) in the case where pure copper is used for a mold copper plate, and thermal expansion coefficient $\alpha m$ is 13.4 μm/(m×K) in the case where nickel is used as a foreign metal.

It is possible to change the values for Vickers hardness HV and thermal expansion coefficient $\alpha$ by changing the chemical composition of a metal or by changing the material of a metal. For example, in the case where chromium is used as a foreign metal instead of nickel, there is an increase in HVm, and there is a decrease in $\alpha m$.

In the case of a continuous casting mold which satisfies relational expressions (1) and (2), a foreign metal is less likely to be detached from the surface of the mold when continuous casting of steel is performed, and a crack is less likely to occur on the surface of the mold. In addition, even if a crack occurs, since the depth of the crack is less likely to be large, there is an increase in the life of the mold. Here, the term "crack" refers to a crack which occurs on the inner wall surface of a mold copper plate, and, in particular, such a crack tends to occur at the interface between the mold copper plate and a foreign metal on the inner wall surface.

<Experiment 3>

When continuous casting of steel is performed, by pouring molten steel into a continuous casting mold, by oscillating the mold, by pouring mold powder onto the surface of the molten steel which has been poured into the mold, and by drawing a solidified shell out of the mold while cooling the mold, a cast piece is manufactured. There have been experiments in which mold powder having a chemical composition which tends to cause crystallization is used in order to prevent a crack on the surface of a cast piece of medium-carbon steel which is accompanied by a peritectic reaction. By using mold powder having a chemical composition which tends to cause crystallization, there is an increase in the thermal resistance of a mold powder layer, and thus the slow cooling of the solidified shell is promoted. As described above, in the case where a continuous casting mold with which the effect of a periodical variation in thermal flux due to portions 3 filled with a foreign metal is realized is used, since there is a decrease in stress applied to the solidified shell due to slow cooling without controlling the chemical composition of the mold powder, it is possible to expect the effect of preventing a surface crack even in the case of a steel grade which is subjected to a large amount of transformation.

However, in accordance with one aspect of the present inventors, in order to prevent a crack on the surface of a cast piece to a higher degree in the case where a cast piece of medium-carbon steel is continuously cast by using the continuous casting mold described above, conducted investigations regarding the chemical composition of mold powder which promotes the slow cooling through the use of portions 3 filled with a foreign metal.

In the case where mold powder, which promotes slow cooling, is used in an ordinary mold, there is a risk of the insufficient thickness of a solidified shell due to a decrease in the amount of heat extracted through the mold. However, in the case of the continuous casting mold described above, since there is an increase in adhesiveness between the solidified shell and the surface of the mold due to a decrease in the amount of deformation of a solidified shell in the vicinity of a meniscus, it is possible to inhibit a decrease in the thickness of the solidified shell because of a tendency for the amount of heat extracted through the mold to increase, which makes it possible to use mold powder which promotes slow cooling and which has been unusable. The chemical composition of such mold powder will be described hereafter.

Figure 8:
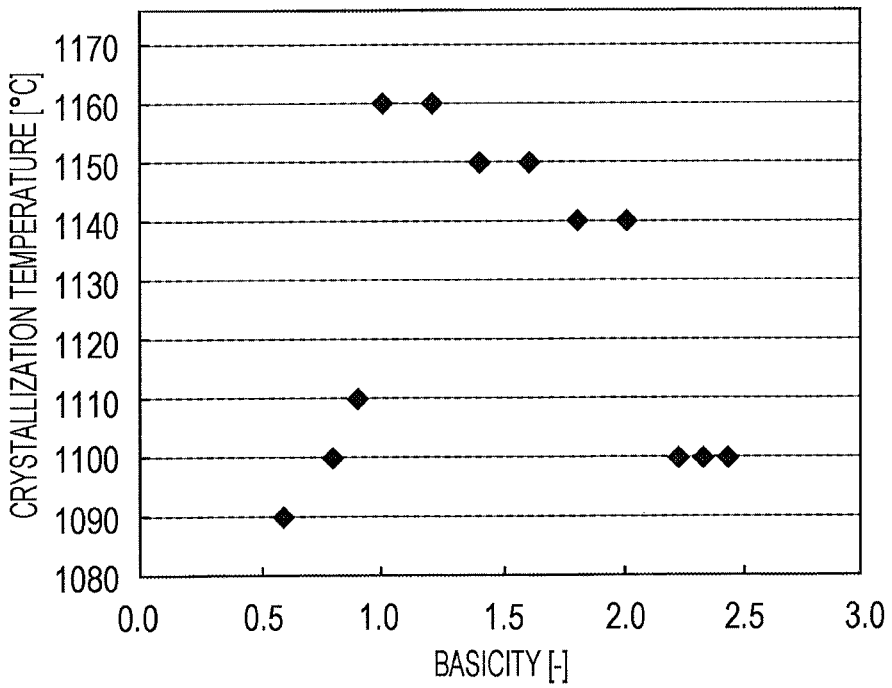
FIG. 8 is a graph illustrating the relationship between the basicity of mold powder and crystallization temperature.

In aspects of the present invention, mold powder containing mainly CaO, $SiO_2$, and $Al_2O_3$ may be used, and the basicity, which is expressed by the ratio ((CaO by mass %)/($SiO_2$ by mass %)) of CaO concentration to $SiO_2$ concentration in the mold powder, is preferably 1.0 or more and 2.0 or less. Here, the term "mold powder containing mainly CaO, $SiO_2$, and $Al_2O_3$" refers to a case where the sum of the concentrations of CaO, $SiO_2$, and $Al_2O_3$ is 80 mass % to 90 mass %. Since basicity is an important index for forming a uniform cuspidine crystal, the present inventors conducted investigations regarding the relationship between the basicity of mold powder and a temperature (crystallization temperature) at which mold powder is crystallized. FIG. 8 illustrates the relationship.

As FIG. 8 indicates, in the case where the basicity of mold powder is 1.0 or more and 2.0 or less, the crystallization temperature is high, and it is possible to expect that the occurrence of a crack is effectively inhibited by the effect of slow cooling in a mold. In the case where the basicity is less than 1.0 or more than 2.0, the crystallization temperature is low, and it is predicted that the effect of slow cooling by the crystallization of mold powder is small.

Although it is clarified that the crystallization temperature is high in the case where the basicity of mold powder is 1.0 or more and 2.0 or less as described above, the present inventors discuss adding some components to mold powder in order to preventing the excessive promotion of slow cooling in a mold by preventing excessive crystallization, that is, in order to preventing an excessive decrease in the thickness of a solidified shell at the exit of a mold.

As a result, it was found that, in the case where mold powder further contains $Na_2O$ and $Li_2O$ and where the sum of $Na_2O$ concentration and $Li_2O$ concentration is 5.0 mass % or more and 10.0 mass % or less, it is possible to achieve a thick solidified shell in a mold while slowly cooling the solidified shell. Hereafter, the test through which the optimum mold powder was found will be described.

The test was performed by using a mold in which portions 3 filled with a foreign metal having a diameter d of 20 mm were formed and by using mold powder containing mainly CaO, $SiO_2$, and $Al_2O_3$ and additionally $Na_2O$ and $Li_2O$. Other conditions were the same as used in the Experiment 1, and continuous casting of steel was performed plural times. The tests were performed by using plural kinds of mold powder having a constant basicity of 1.5 and various values for the sum of $Na_2O$ concentration and $Li_2O$ concentration. In order to clarify the influence of mold powder on the amount of heat extracted through a mold, the flow rate of cooling water fed to the mold was the same in all the tests.

Figure 9:
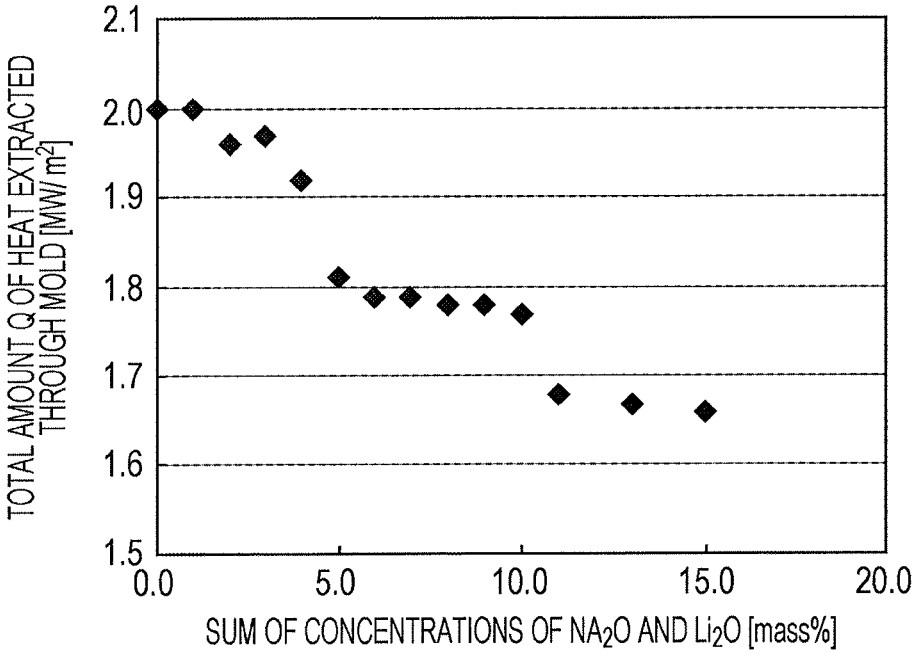
FIG. 9 is a graph illustrating the relationship between the sum of $Na_2O$ concentration and $Li_2O$ concentration of mold powder and the total amount Q of heat extracted through a mold.

By using the results of the plural tests, the influence of the sum of $Na_2O$ concentration and $Li_2O$ concentration of mold powder on the total amount Q of heat extracted through a mold was investigated. FIG. 9 is a graph illustrating the relationship between the sum of $Na_2O$ concentration and $Li_2O$ concentration of mold powder and the total amount Q of heat extracted through a mold.

As FIG. 9 indicates, in the case where the sum of $Na_2O$ concentration and $Li_2O$ concentration is less than 5.0 mass %, there is a tendency for the total amount Q of heat extracted through a mold to increase, and thus it is difficult to realize slow cooling in a mold. On the other hand, in the case where the sum of $Na_2O$ concentration and $Li_2O$ concentration is more than 10.0 mass %, slow cooling in a mold is excessively promoted as a result of the crystallization of mold powder being promoted more than necessary, and thus the thickness of the solidified shell at the exit of the mold is small, which raises a risk of breakout occurring. It is clarified that, in the case where the sum of $Na_2O$ concentration and $Li_2O$ concentration of mold powder is 5.0 mass % or more and 10.0 mass % or less, the total amount Q of heat extracted through a mold takes a medium value. That is, in combination with the effect of homogenizing the shell solidification through the use of a filling foreign metal, it is possible to inhibit a crack on the surface of a cast piece to a higher degree.

Although mold powder contains mainly CaO, $SiO_2$, and $Al_2O_3$ and additionally $Na_2O$ and $Li_2O$, other components may further be contained. Mold powder may contain, for example, MgO, $CaF_2$, BaO, MnO, $B_2O_3$, $Fe_2O_3$, and $ZrO_2$ and, in order to control the melting rate of mold powder, carbon, and mold powder may contain other inevitable impurities.

Mold powder poured onto a meniscus melts and enters between the inner wall surface of a oscillating mold and a solidified shell. At this time, the oscillation stroke may be 4 mm to 10 mm, and the variation frequency may be 50 cpm to 180 cpm.

<Experiment 4>

Tests were performed by using mold powder having a sum of $Na_2O$ concentration and $Li_2O$ concentration of 7.5 mass % with various flow rates of cooling water fed to a mold in order to forcibly vary the total amount Q of heat extracted through a mold. Other conditions were the same as used in the Experiment 3, and continuous casting of steel was performed plural times.

From the results of the plural tests, the relationship between the total amount Q of heat extracted through a mold and the number density of cracks on the surface of a cast slab was obtained. In these tests, by defining the number density index of surface cracks of each of the tests as the ratio of number density (number/$m^2$) of cracks on the surface of a cast slab to the number density (number/$m^2$) of cracks on the surface of a cast slab which was manufactured by performing continuous casting of steel with a conventional mold, as a continuous casting mold, in which no portion 3 filled with a foreign metal was formed so that the index of the cast slab which was manufactured by performing continuous casting of steel with a conventional mold in which no portion 3 filled with a foreign metal was formed was 1.0, the index was used as the measure of the number of surface cracks.

Figure 10:
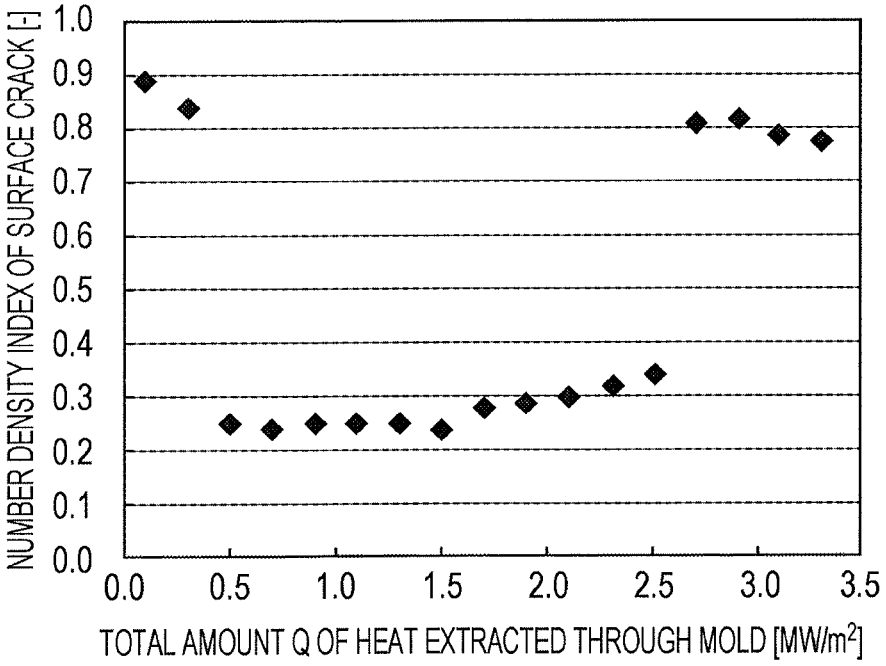
FIG. 10 is a graph illustrating the relationship between the total amount Q of heat extracted through a mold and the number density index of cracks on the surface of a cast slab.

FIG. 10 is a graph illustrating the relationship between the total amount Q of heat extracted through a mold and the number density index of cracks on the surface of a cast slab. As FIG. 10 indicates, it is clarified that, in the case where the total amount Q of heat extracted through a mold is 0.5 $MW/m^2$ or more and 2.5 $MW/m^2$ or less, it is possible to significantly decrease the number of surface cracks. Here, in the case where the total amount Q of heat extracted through a mold is about 1.5 $MW/m^2$ to 2.5 $MW/m^2$, there is a tendency observed for the number density index of surface cracks to slightly increase with an increase in the total amount Q of heat extracted through a mold. It is presumed that this is because, although there is an effect due to a filling foreign metal, there is a decrease in the effect of slow cooling.

That is, in the case where continuous casting of steel is performed by pouring molten steel into a continuous casting mold in which portions 3 filled with a foreign metal were formed and by pouring mold powder containing mainly CaO, $SiO_2$, and $Al_2O_3$ and additionally $Na_2O$ and $Li_2O$ onto the surface of the molten steel in the mold, it is preferable that the mold be cooled so that the total amount Q of heat extracted through a mold is 0.5 $MW/m^2$ or more and 2.5 $MW/m^2$ or less. With this, it is possible to significantly decrease the number of cracks on the surface of a cast slab.

<Experiment 5>

The influence of the breaking elongation of a coating layer (formed by using a plating method or thermal spraying method) formed on the inner wall surface of a mold copper plate on the occurrence of a crack on the surface of a mold was investigated. The term "breaking elongation of a coating layer" here refers to "percentage elongation after fracture" determined in accordance with "Metallic materials-Tensile testing" prescribed in JIS Z 2241.

Figure 11:
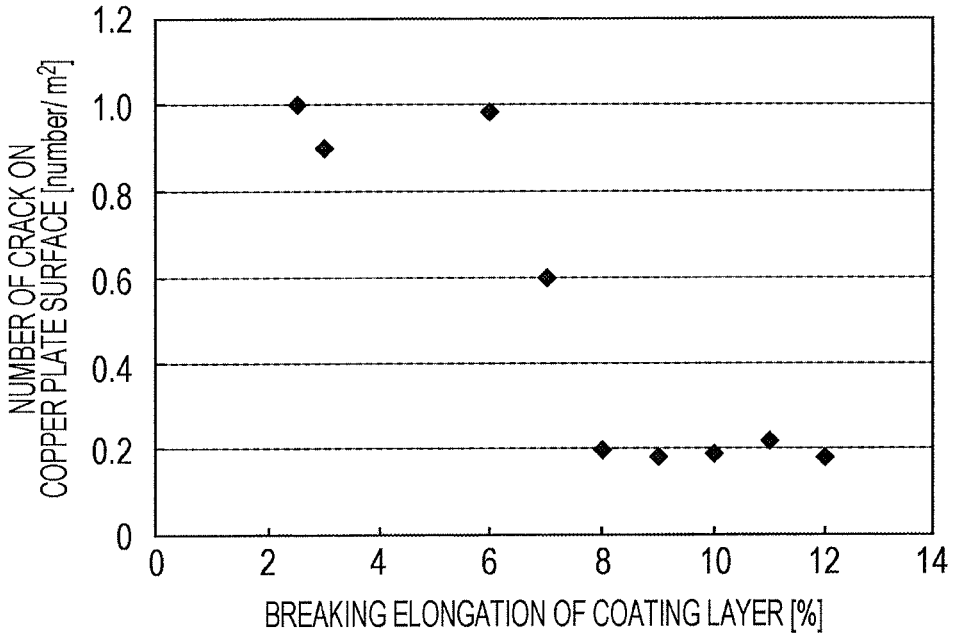
FIG. 11 is a graph illustrating the relationship between the breaking elongation of a coating layer and the number of cracks of a copper plate.

By forming plural portions 3 filled with a foreign metal on the surface of a copper plate, and by further forming a coating layer covering these portions 3 filled with a foreign metal by using a plating method, samples having coating layers having different values for breaking elongations were prepared. By performing a thermal fatigue test (JIS 2278, higher temperature: 700° C., lower temperature: 25° C.) on these samples, mold life was evaluated on the basis of the number of cracks which had occurred on the surface of the samples. FIG. 11 is a graph illustrating the relationship between the breaking elongation of a coating layer and the number of cracks of a copper plate.

It was clarified that, in the case where the breaking elongation of a coating layer is 8% or more, it is possible to inhibit a crack on the surface of a copper plate caused by the thermal expansion of the copper plate and portions 3 filled with a foreign metal. In addition, it is not preferable that the breaking elongation of a coating layer be less than 8%, because, since it is not possible to decrease the influence of the thermal expansion of the copper plate and portions 3 filled with a foreign metal, a crack tends to occur on the surface of the copper plate.

As described above, according to aspects of the present invention, since plural portions 3 filled with a foreign metal are arranged in the width direction and casting direction of a continuous casting mold in a region in the vicinity of a meniscus including the meniscus, the thermal resistance of the continuous casting mold increases and decreases regularly and periodically in the width direction and casting direction of the mold in the vicinity of the meniscus. With this, the thermal flux from a solidified shell to the continuous casting mold increases and decreases regularly and periodically in the vicinity of the meniscus, that is, in the early solidification stage. As a result of such regular and periodic increase and decrease in thermal flux, since there is a decrease in stress due to transformation from δ iron to γ iron and in thermal stress, there is a decrease in the amount of deformation of the solidified shell caused by these stresses. As a result of a decrease in the amount of deformation of the solidified shell, an inhomogeneous distribution of thermal flux caused by the deformation of the solidified shell is homogenized, and, since generated stress is de-concentrated, there is a decrease in the amounts of various strains, which results in a crack being prevented from occurring on the surface of the solidified shell.

Moreover, since the ratio of the Vickers hardness HVc of the mold copper plate to the Vickers hardness HVm of the foreign metal and the ratio of the thermal expansion coefficient $\alpha c$ of the mold copper plate to the thermal expansion coefficient $\alpha m$ of the foreign metal are controlled to be within the specified ranges, it is possible to decrease stress applied to the surface of the mold caused by the difference in the amount of abrasion of the surface of the mold due to the difference in hardness between the mold copper plate and the portions filled with a foreign metal, and due to the difference in thermal expansion. Therefore, the life of the mold becomes longer.

In addition, since the total amount Q of heat extracted through a mold is controlled to be within the specified range by controlling the chemical composition of mold powder and by controlling the flow rate of cooling water fed, it is possible to prevent a crack from occurring on the surface of a solidified shell, and it is possible to inhibit a crack from occurring in a cast slab.

EXAMPLES

By preparing a water-cooled copper mold as illustrated in FIG. 1 in which plural circular portions having a diameter of 20 mm filled with a foreign metal were formed on the inner wall surface of the mold copper plate, and by casting medium-carbon steel (having a chemical composition containing C: 0.08 mass % to 0.17 mass %, Si: 0.10 mass % to 0.30 mass %, Mn: 0.50 mass % to 1.20 mass %, P: 0.010 mass % to 0.030 mass %, S: 0.005 mass % to 0.015 mass %, and Al: 0.020 mass % to 0.040 mass %) by using the prepared water-cooled copper mold, a test was carried out in order to investigate cracks on the surface of the cast pieces. The inner space of the water-cooled copper mold had a long side length of 1.8 m and a short side length of 0.26 m.

The length (=mold length) from the upper edge to the lower edge of the used water-cooled copper mold was 900 mm, and the position of a meniscus (the upper surface of molten steel in the mold) when ordinary casting is performed was set to be 100 mm lower than the upper edge of the mold. Circular concave grooves were formed in the region between a position 80 mm lower than the upper edge of the mold and a position 300 mm lower than the upper edge of the mold on the inner wall surface of the mold copper plate (distance Q=20 mm, distance R=200 mm, the length of the region: (distance Q+distance R)=220 mm), and portions filled with a foreign metal were formed by filling the circular concave grooves with a foreign metal such as a nickel alloy (having a thermal conductivity of 80 W/(m·K)) by using a plating method.

By using a copper alloy having a thermal conductivity of about 380 W/(m·K), a Vickers hardness HVc of 37.6 $kgf/mm^2$, and a thermal expansion coefficient $\alpha c$ of 16.5 μm/

(m·K) for a mold copper plate, continuous casting of steel was performed plural times with the circular concave grooves being filled with various kinds of foreign metal, with various chemical compositions of mold powder, and with various values for the total amount Q of heat extracted through a mold (examples 1 through 11 of the present invention and comparative examples 1 through 7). In addition, for comparison with examples 1 through 11 of the present invention and comparative examples 1 through 7, continuous casting of steel was performed by using an ordinary continuous casting mold in which no portion filled with a foreign metal is formed (conventional example).

The conditions and so forth such as the values for the Vickers hardness HVm and thermal expansion coefficient αm of the foreign metal of the continuous casting molds used in examples 1 through 11 of the present invention and comparative examples 1 through 7 and the values for the basicity of the mold powder, the values for the sum of $Na_2O$ concentration and $Li_2O$ concentration, and the total amount Q of heat extracted through a mold used in examples 1 through 11 of the present invention, comparative examples 1 through 7, and the conventional example are given in Table 1.

TABLE 1

| | HVm [kgf/mm$^2$] | αm [μm/(m × K)] | HVc/HVm [-] | αc/aα [-] | Basicity [-] | $Na_2O + Li_2O$ [mass %] | Total Amount Q of Heat Extracted through Mold [MW/m$^2$] | Breaking Elongation of Coating Layer [%] |
|---|---|---|---|---|---|---|---|---|
| Conventional Example | — | — | — | — | 2.1 | 0 | 2.6 | 5.0 |
| EXAMPLE 1 | 65.1 | 13.4 | 0.58 | 1.23 | 1.2 | 6.5 | 2.1 | 9.0 |
| EXAMPLE 2 | 108.1 | 4.9 | 0.35 | 3.37 | 1.3 | 5.7 | 2.0 | 10.0 |
| EXAMPLE 3 | 106.4 | 13.0 | 0.35 | 1.27 | 1.6 | 7.2 | 1.9 | 8.5 |
| EXAMPLE 4 | 17.0 | 23.1 | 2.21 | 0.71 | 1.8 | 6.1 | 1.7 | 6.0 |
| EXAMPLE 5 | 65.1 | 13.4 | 0.58 | 1.23 | 1.5 | 6.5 | 0.5 | 11.0 |
| EXAMPLE 6 | 65.1 | 14.5 | 0.58 | 1.14 | 1.4 | 6.3 | 1.7 | 12.0 |
| EXAMPLE 7 | 71.4 | 13.4 | 0.53 | 1.23 | 1.2 | 4.2 | 1.8 | 8.6 |
| EXAMPLE 8 | 65.1 | 15.6 | 0.58 | 1.06 | 2.3 | 9.2 | 1.1 | 3.0 |
| EXAMPLE 9 | 65.1 | 13.4 | 0.58 | 1.23 | 0.9 | 5.2 | 2.8 | 10.5 |
| EXAMPLE 10 | 65.1 | 13.4 | 0.58 | 1.23 | 0.8 | 4.5 | 0.7 | 3.5 |
| EXAMPLE 11 | 65.1 | 13.4 | 0.58 | 1.23 | 0.8 | 4.5 | 0.4 | 10.8 |
| COMPARATIVE EXAMPLE 1 | 65.1 | 35.6 | 0.58 | 0.46 | 1.2 | 6.5 | 1.6 | 9.6 |
| COMPARATIVE EXAMPLE 2 | 14.6 | 13.4 | 2.58 | 1.23 | 1.5 | 7.2 | 0.9 | 9.4 |
| COMPARATIVE EXAMPLE 3 | 14.6 | 35.6 | 2.58 | 0.46 | 1.5 | 6.5 | 0.7 | 7.4 |
| COMPARATIVE EXAMPLE 4 | 147.9 | 4.2 | 0.25 | 3.93 | 1.5 | 6.8 | 2.8 | 8.9 |
| COMPARATIVE EXAMPLE 5 | 14.6 | 4.2 | 2.58 | 3.93 | 2.2 | 10.2 | 2.4 | 5.0 |
| COMPARATIVE EXAMPLE 6 | 147.9 | 35.6 | 0.25 | 0.46 | 2.2 | 3.5 | 0.4 | 8.2 |
| COMPARATIVE EXAMPLE 7 | 14.6 | 4.2 | 2.58 | 3.93 | 0.8 | 11.1 | 2.8 | 3.0 |

The molds in examples 1 through 11 of the present invention satisfied the conditions that the ratio (HVc/HVm) of the Vickers hardness HVc of a mold to the Vickers hardness HVm of the filling metal is 0.3 or more and 2.3 or less and that the ratio (αc/αm) of the thermal expansion coefficient αc of the mold and the thermal expansion coefficient αm of the filling metal is 0.7 or more and 3.5 or less. Therefore, the molds in examples 1 through 11 of the present invention satisfied the relational expressions (1) and (2). On the other hand, the comparative examples satisfied only one or none of relational expressions (1) and (2).

Figure 12:
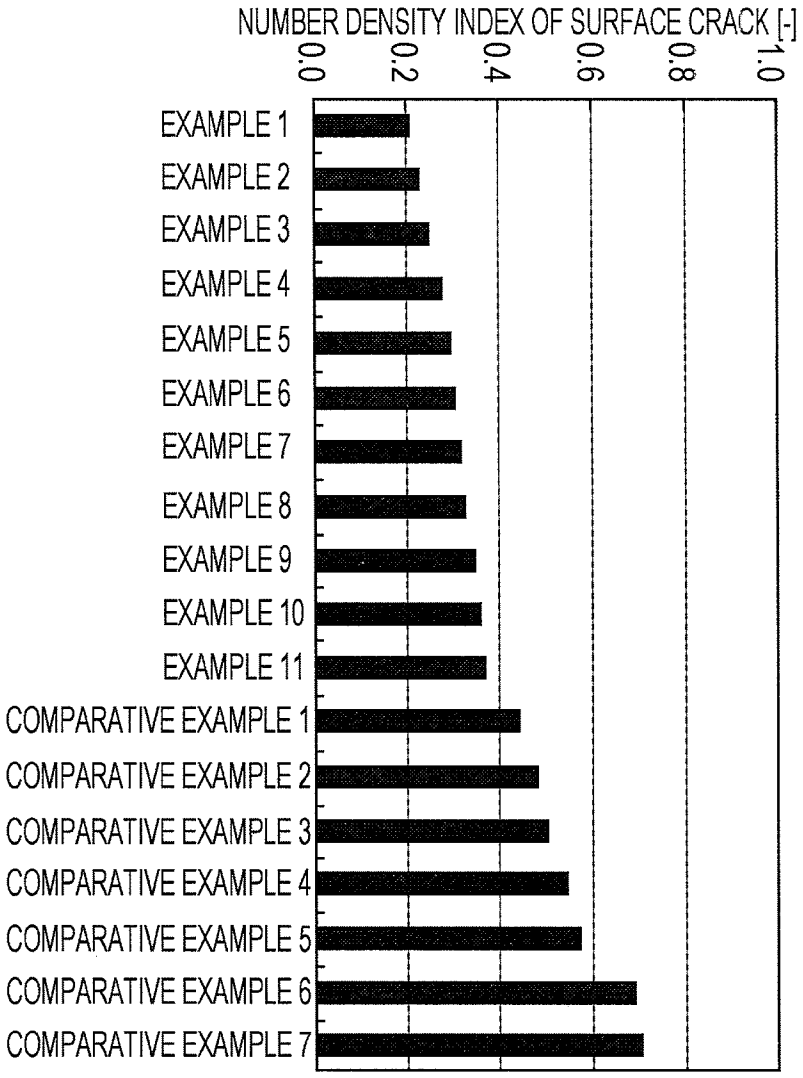
FIG. 12 is a graph illustrating the comparison results of the number density indexes of cracks on the surfaces of cast slabs in the examples.

In examples 1 through 11 of the present invention, comparative examples 1 through 7, and the conventional example, the density of cracks on the surface of the manufactured cast slabs was determined. By finding cracks on the surface of the cast slab by performing a visual test using color check, by determining the length of each of longitudinal cracks on the surface of the cast piece, by defining a longitudinal crack having a length of 1 cm or more as a surface crack, and by counting the number of surface cracks, the number density of surface crack (number/m$^2$) was calculated. By defining the number density index of surface cracks of each of the tests as the ratio of number density (number/m$^2$) of cracks on the surface of a cast slab to the number density (number/m$^2$) of cracks on the surface of a cast slab in the conventional example so that the index of the cast slab in the conventional example was 1.0, the index was used as the measure of the number of surface cracks. FIG. 12 illustrates the number density indexes of surface cracks in examples 1 through 11 of the present invention and comparative examples 1 through 7.

As FIG. 12 indicates, while the number density index of surface cracks is less than 0.4 in the case of the examples 1 through 11 of the present invention, the index is more than 0.4 in the case of comparative examples 1 through 7. Therefore, it is clarified that, according to the present invention in which relational expressions (1) and (2) are satisfied, it is possible to prevent a crack from occurring on the surface of a solidified shell, and it is possible to inhibit a crack from occurring in a cast slab.

REFERENCE SIGNS LIST

1 copper plate on the long side of a mold
2 circular concave groove
3 portion filled with a foreign metal
4 coating layer formed by using a plating method
5 cooling water flow channel
6 back plate

The invention claimed is:

1. A continuous casting mold having a mold copper plate composed of copper or a copper alloy, the mold comprising:

plural separate portions filled with a foreign metal of which thermal conductivity is 80% or less of thermal conductivity of the mold copper plate or 125% or more thereof, the plural separate portions being provided on an inner wall surface of the mold copper plate so that thermal resistance of the mold increases and decreases regularly and periodically in a width direction and a casting direction of the mold in vicinity of a meniscus, and the plural separate portions being formed at least in a region from a meniscus to a position located 20 mm or more lower than the meniscus, the region being whole or part of the inner wall surface, wherein, a ratio of Vickers hardness HVc [kgf/mm$^2$] of the mold copper plate to Vickers hardness HVm [kgf/mm$^2$] of filled foreign metal satisfies relational expression (1) below:

$$0.3 \leq HVc/HVm \leq 2.3 \quad (1), \text{ and}$$

the ratio of the thermal expansion coefficient $\alpha c$ [μm/(m×K)] of the mold copper plate to the thermal expansion coefficient $\alpha m$ [μm/(m×K)] of the filled foreign metal satisfies relational expression (2) below:

$$0.7 \leq \alpha c/\alpha m \leq 3.5 \quad (2),$$

wherein a coating layer is formed on the inner wall surface by a plating method or a thermal spraying method, the coating layer having a breaking elongation of 8% or more, and the portions filled with the foreign metal are covered with the coating layer, wherein the coating layer consists of a cobalt-nickel alloy, wherein the cobalt-nickel alloy has a cobalt content of 50 mass % or more.

2. A method for continuous casting of steel using the continuous casting mold according to claim 1, the method comprising steps of:

pouring molten steel into the mold and cooling the molten steel in the mold to form a solidified shell; and drawing a cast piece having the solidified shell as an outer shell and non-solidified molten steel inside the solidified shell out of the mold in order to manufacture a cast piece.

3. The method for continuous casting of steel according to claim 2, the method further comprising steps of:

oscillating the mold copper plate; and pouring mold powder onto the surface of the molten steel which has been poured into the mold during the oscillating, wherein the mold powder contains CaO, $SiO_2$, $Al_2O_3$, $Na_2O$, and $Li_2O$ and the basicity, which is expressed by the proportion of CaO concentration to $SiO_2$ concentration in the mold powder is 1.0 or more and 2.0 or less, and wherein the sum of $Na_2O$ concentration and $Li_2O$ concentration is 5.0 mass % or more and 10.0 mass % or less.

4. The method for continuous casting of steel according to claim 3, the method further comprising steps of:

cooling the mold so that the total amount Q of heat extracted through the mold is 0.5 MW/m$^2$ or more and 2.5 MW/m$^2$ or less.

5. The continuous casting mold according to claim 1, wherein the thickness of the coating layer is 2.0 mm or less.

6. The continuous casting mold according to claim 1, wherein the coating layer is the innermost layer of the continuous casting mold.

7. The continuous casting mold according to claim 1, wherein the inner wall surface of the mold copper plate consists of plural separate portions filled with the foreign metal and the coating layer.

8. A continuous casting mold having a mold copper plate composed of copper or a copper alloy, the mold comprising:

plural separate portions filled with a foreign metal of which thermal conductivity is 80% or less of thermal conductivity of the mold copper plate or 125% or more thereof, the plural separate portions being formed as circular concave grooves having a diameter of 2 mm to 20 mm or as quasi-circular concave grooves having a circle-equivalent diameter of 2 mm to 20 mm, the grooves being provided on an inner wall surface of the mold copper plate, and the plural separate portions being formed at least in a region from a meniscus to a position located 20 mm or more lower than the meniscus, the region being whole or part of the inner wall surface, wherein, a ratio of Vickers hardness HVc [kgf/mm$^2$] of the mold copper plate to Vickers hardness HVm [kgf/mm$^2$] of filled foreign metal satisfies relational expression (1) below:

$$0.3 \leq HVc/HVm \leq 2.3 \quad (1), \text{ and}$$

the ratio of the thermal expansion coefficient $\alpha c$ [μm/(m×K)] of the mold copper plate to the thermal expansion coefficient $\alpha m$ [μm/(m×K)] of the filled foreign metal satisfies relational expression (2) below:

$$0.7 \leq \alpha c/\alpha m \leq 3.5 \quad (2),$$

wherein a coating layer is formed on the inner wall surface by a plating method or a thermal spraying method, the coating layer having a breaking elongation of 8% or more, and the portions filled with the foreign metal are covered with the coating layer, wherein the coating layer consists of a cobalt-nickel alloy, wherein the cobalt-nickel alloy has a cobalt content of 50 mass % or more.

9. A method for continuous casting of steel using the continuous casting mold according to claim 8, the method comprising steps of:

pouring molten steel into the mold and cooling the molten steel in the mold to form a solidified shell; and drawing a cast piece having the solidified shell as an outer shell and non-solidified molten steel inside the solidified shell out of the mold in order to manufacture a cast piece.

10. The method for continuous casting of steel according to claim 9, the method further comprising steps of:

oscillating the mold copper plate; and pouring mold powder onto the surface of the molten steel which has been poured into the mold during the oscillating, wherein the mold powder contains CaO, $SiO_2$, $Al_2O_3$, $Na_2O$, and $Li_2O$ and the basicity, which is expressed by the proportion of CaO concentration to $SiO_2$ concentration in the mold powder is 1.0 or more and 2.0 or less, and wherein the sum of $Na_2O$ concentration and $Li_2O$ concentration is 5.0 mass % or more and 10.0 mass % or less.

11. The method for continuous casting of steel according to claim 10, the method further comprising steps of:

cooling the mold so that the total amount Q of heat extracted through the mold is 0.5 $MW/m^2$ or more and 2.5 $MW/m^2$ or less.

12. The continuous casting mold according to claim 8, wherein the thickness of the coating layer is 2.0 mm or less.

13. The continuous casting mold according to claim 8, wherein the coating layer is the innermost layer of the continuous casting mold.

14. The continuous casting mold according to claim 8, wherein the inner wall surface of the mold copper plate consists of plural separate portions filled with the foreign metal and the coating layer.

* * * * *